US010790132B2

(12) United States Patent
Sakagoshi

(10) Patent No.: US 10,790,132 B2
(45) Date of Patent: Sep. 29, 2020

(54) TIME-OF-FLIGHT MASS SPECTROMETER

(71) Applicant: SHIMADZU CORPORATION, Kyoto-shi, Kyoto (JP)

(72) Inventor: Yusuke Sakagoshi, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 69 days.

(21) Appl. No.: 16/324,395

(22) PCT Filed: Jan. 25, 2017

(86) PCT No.: PCT/JP2017/002598
§ 371 (c)(1),
(2) Date: Feb. 8, 2019

(87) PCT Pub. No.: WO2018/138814
PCT Pub. Date: Aug. 2, 2018

(65) Prior Publication Data
US 2020/0219714 A1 Jul. 9, 2020

(51) Int. Cl.
*H01J 49/24* (2006.01)
*H01J 49/40* (2006.01)

(52) U.S. Cl.
CPC ..... *H01J 49/405* (2013.01); *H01J 49/24* (2013.01); *H01J 49/403* (2013.01)

(58) Field of Classification Search
CPC ..... H01J 49/405; H01J 49/24; H01J 49/403
(Continued)

(56) References Cited

U.S. PATENT DOCUMENTS 3,727,047 A 4/1973 Janes
8,669,518 B2 * 3/2014 Ishiguro ..... H01J 49/0013 250/281
(Continued)

FOREIGN PATENT DOCUMENTS

CA 2 913 931 A1 6/2016
CN 102737951 A 10/2012
(Continued)

OTHER PUBLICATIONS

International Search Report for PCT/JP2017/002598 dated Apr. 25, 2017 (PCT/ISA/210).
(Continued)

*Primary Examiner* — Nicole M Ippolito
(74) *Attorney, Agent, or Firm* — Sughrue Mion, PLLC

(57) ABSTRACT

The present invention provides a time-of-flight mass spectrometer (TOFMS) taken measures for preventing a deterioration in accuracy caused at the time of transportation to an installation site. A time-of-flight mass spectrometer (TOFMS) for performing mass separation based on the time of flight of an ion flying in a flight space includes an ion transportation unit (12, 14, 15) configured to transport an ion, an acceleration unit (expulsion electrode (161) and the like) configured to receive the ion transported by the ion transportation unit and accelerate the ion to introduce the ion into the flight space, a flight unit incorporating the flight space, a first vacuum vessel (18A) enclosing the ion transportation unit, the acceleration unit, and at least a part of the flight unit, a chassis (19) on which the first vacuum vessel (18A) is placed, and a reflector unit (20) to which a reflector (reflection (164)) and a second vacuum vessel (28) are fixed, the reflection (164) being configured to reverse the flight trajectory of the ion accelerated by the acceleration unit and introduced into the flight space, and the second vacuum vessel (28) being attachable to an end of the first vacuum
(Continued)

vessel (18A) and enclosing the reflector. Since the reflector unit (20) is separated from other parts during transportation, the other parts are easily moved by, for example, casters (191) disposed on the chassis (19), and the reflector unit (20) is moved without being affected by the vibrations caused by the movement on the casters (191).

8 Claims, 4 Drawing Sheets

(58) Field of Classification Search
USPC ..... 250/281, 282, 283, 286, 287
See application file for complete search history.

(56) References Cited

U.S. PATENT DOCUMENTS

2006/0016983 A1* 1/2006 Kobayashi ..... H01J 49/401 250/288
2011/0266438 A1* 11/2011 Harada ..... H01J 49/0004 250/288
2012/0248305 A1 10/2012 Noda et al.
2014/0239170 A1 8/2014 Okumura
2016/0163530 A1 6/2016 Syage
2019/0285584 A1* 9/2019 Wu ..... H01J 9/062

FOREIGN PATENT DOCUMENTS

EP 2 506 286 A2 10/2012
EP 3 032 570 A2 6/2016
JP 2008135192 A 6/2008
JP 2009-137368 A 6/2009
JP 2012-216339 A 11/2012
JP 2014-165053 A 9/2014

OTHER PUBLICATIONS

Written Opinion dated Apr. 25, 2017 in application No. PCT/JP2017/002598.
Notice of Reasons for Refusal dated Sep. 10, 2019 from the Japanese Patent Office in application No. 2018-563999.
Communication dated Dec. 19, 2019, from the European Patent Office in European Application No. 17894530.9.
Jordan Tof Products, Inc., "Instruction Manual: Positive Ion D-1803 oaRETOF Time of Flight Power Supply for D-851 Orthogonal Acceleration Angular Reflectron", Time of Flight, oaRETOF P.S. PC Board REV-1, Dec. 4, 2015, pp. 1-24 (24 pages total).

* cited by examiner

TIME-OF-FLIGHT MASS SPECTROMETER

CROSS REFERENCE TO RELATED APPLICATIONS

This application is a National Stage of International Application No. PCT/JP2017/002598 filed Jan. 25, 2017.

TECHNICAL FIELD

The present invention relates to a time-of-flight mass spectrometer (hereinafter abbreviated as "TOFMS").

BACKGROUND ART

Generally, a TOFMS gives a predetermined kinetic energy to an ion derived from a sample component to make the ion fly through a space by a predetermined distance, and measures the time required for the flight, thereby calculating the mass-to-charge ratio of the ion from the flight time.

The TOFMS performs various processes including operations such as temporarily trapping ions generated, selecting only ions within a predetermined narrow mass-to-charge ratio range, and dissociating the ions. A TOF unit in a succeeding stage separates ions with high accuracy in accordance with their mass-to-charge ratios (m/z ratios). In order to enhance the feature of high accuracy separation, one equipped with a reflection for extending an ion flight distance is often used as the TOF unit in the succeeding stage.

As an example of such a TOFMS. FIG. 7 shows a schematic configuration of a tandem mass spectrometer (Patent Literature 1). The tandem mass spectrometer has, in a vacuum vessel 18 an ion source 11, a quadrupole mass filter 12, a collision cell 13 incorporating an ion guide 14, an ion trap 15, a time-of-flight mass separator 16 of a reflectron type, and an ion detector 17. Usually, ion optical elements such as an ion guide and an ion lens for efficiently transporting ions to a subsequent stage are provided between the ion source 11 and the quadrupole mass filter 12 or at other appropriate positions. However, a description of such elements will be omitted here. Referring to FIG. 7, the ion trap 15 has a three-dimensional quadrupole type configuration in which a pair of end cap electrodes 152 and 153 are provided, with a ring electrode 151 being disposed between them. However, the ion trap 15 may have any configuration for storing ions, and is sometimes replaced with a linear ion trap or the like.

The time-of-tlight mass separator 16 has an orthogonal acceleration type ion acceleration unit including an expulsion electrode 161 and a grid electrode 162 for accelerating ions that have traveled from the ion source 11 in the preceding stage to the ion trap 15 in a direction orthogonal to their traveling direction. A reflectron 164 composed of a number of plate-shaped electrodes is disposed at the rear end (lower end in FIG. 7) of a TOFMS flight space 163 in the succeeding stage which extends orthogonal to the ion flight axis of the preceding stage.

The ion source 11 in the preceding stage ionizes various compounds contained in the sample. The quadrupole mass filter 12 passes only precursor ions having a designated specific mass-to-charge ratio. The precursor ions are dissociated inside the collision cell 13 and produce various fragments (product ions and neutral losses). Product ions generated by the dissociation, and precursor ions not dissociated, are introduced into and trapped by the ion trap 15. The ion trap 15 temporarily captures the ions, and ejects the ions in a packet form to send to an ion acceleration unit of the time-of-flight mass separator 16.

Applying a predetermined voltage between the expulsion electrode 161 and the grid electrode 162 at the timing when the ion packet arrives at the ion acceleration unit, each ion in the ion packet is given an initial kinetic energy, and accelerated in a direction substantially orthogonal to the initial traveling direction. The accelerated ions are introduced into the flight space 163, are made to fly back by the action of a reflection electric field formed by the reflectron 164, and lastly reach the ion detector 17.

The TOFMS using the reflection can implement highly accurate analysis for the following reasons in addition to a reason that the flight distance of an ion is extended as described above.

The TOFMS applies a predetermined acceleration energy to an ion derived from a target component to make the ion fly through a space by a predetermined distance, and measures the length of time required for the flight, thereby calculating the mass-to-charge ratio of the ion from the time of flight. Even if ions have the same mass-to-charge ratio, when the initial kinetic energy of individual ions in the direction of acceleration varies before acceleration, the variation brings about a difference in flight velocity, and time differences develop when the ions reach the ion detector. The time differences lead to a decrease in mass resolution. Therefore, in order to achieve high mass resolution in the TOFMS, it is important to reduce the influence of the variation of initial kinetic energy of ions.

In order to avoid differences in the time of flight of ions having the same mass-to-charge ratio arising from variations in the initial kinetic energy, the reflectron that reverses the flight trajectory of the ions by the reflection electric field is effective. That is, when ions enter a reflection electric field formed by the reflection, ions having a larger energy advance farther before being reflected even if they have the same mass-to-charge ratio. Therefore, ions with a larger energy and larger flight velocity have longer practical flight distances, which compensates for the differences in the time of flight. This makes it possible to improve the time convergence (or energy convergence) of ions having the same mass-to-charge ratio in a TOFMS with a reflectron and to improve mass resolution.

CITATION LIST

Patent Literature

Patent Literature 1: JP 2014-165053 A

SUMMARY OF INVENTION

Technical Problem

In an actual product of the TOFMS having the above configuration, the front-stage units, the TOF unit, and other units are housed in the vacuum vessel 18. The completed overall product is fixed on a chassis 19. The TOFMS thus assembled and manufactured in a factory is transported to a place (hereinafter referred to as an installation site) where a user uses it by a truck and other means. In the meantime, the TOFMS is transported first to a loading/unloading site near the installation site by a truck and other means. After being unloaded from the truck and other means, the TOFMS is moved to the installation site by using casters 191 attached to the bottom surface of the chassis. Alternatively, the TOFMS is mounted on a carriage with casters (without providing casters for the chassis) and moved to the installation site. After the movement, the TOFMS is fixed with stoppers 192.

However, when the user actually uses the TOFMS that has been transported to the installation site in this way, it sometimes occurs that the same degree of accuracy as that established (built-in) in the product at the time of production cannot be obtained.

It is an object of the present invention to provide a TOFMS taken measures for preventing such a deterioration in accuracy caused at the time of transportation to an installation site.

Solution to Problem

According to the present invention made to solve the above-mentioned problems, a time-of-flight mass spectrometer for performing mass separation based on a time of flight of an ion flying in a flight space includes:

a) an ion transportation unit configured to transport an ion;

b) an acceleration unit configured to receive the ion transported by the ion transportation unit and accelerate the ion to introduce the ion into the flight space;

c) a flight unit incorporating the flight space;

d) a first vacuum vessel enclosing the ion transportation unit, the acceleration unit, and at least a part of the flight unit;

e) a chassis on which the first vacuum vessel is placed; and f) a reflector unit to which a reflector and a second vacuum vessel are fixed, the reflector being configured to reverse a flight trajectory of the ion accelerated by the acceleration unit and introduced into the flight space, and the second vacuum vessel being attachable to an end of the first vacuum ressel and enclosing the reflector.

The flight unit may include various devices, such as a quadrupole mass filter, internally having a space in which ions generated by the ion source fly horizontally.

As a result of investigations to solve the above-mentioned problems, the present inventor has found that the reflectron in a TOFMS in particular is a cause of the deterioration in accuracy. That is, the reflectron is constituted by a number of doughnut-shaped flat-plate electrodes arrayed in parallel with each other with their central axes being aligned. As described above, in reflecting ions, high accuracy is required for the placement of each electrode plate to form an electric field so as to compensate for variations in initial kinetic energy. However, even if a reflectron is produced with high accuracy in a factory, vibrations during transportation of the TOFMS sometimes cause the displacement of the electrode plates, resulting in a deterioration in accuracy of the TOFMS as a whole.

In the TOFMS according to the present invention, the reflector unit is separated from the first vacuum vessel and the part of the flight unit accommodated in the first vacuum vessel. The folio ing describes how to transport the TOFMS from the factory where the TOFMS is completed to an installation site where the TOFMS is used, and then to install the TOFMS at the installation site.

(1) First, the finished TOFMS is separated into a reflector unit, and an ion transportation unit, an acceleration unit, (at least a part of) a flight unit, a first vacuum vessel, and a chassis on which these components are mounted (hereinafter referred to collectively as a main body unit).

(2) The main body unit and the reflector unit are transported by transportation means such as a truck to a loading/unloading site near the installation site. Here, at least the reflector unit is transported by a method with special care in order to prevent vibrations from giving to the reflector unit.

(3) The main body unit and the reflector unit are unloaded from the transportation means at the loading/unloading, site. The main body unit has casters disposed on the chassis or is mounted on a carriage with casters, and is moved to the installation site by the casters. At this time, although vibrations are generated accompanying the rotation of the casters, the reflector unit is not affected by the vibrations since the reflector unit is not fixed to the main body unit (4) The reflector unit is moved from the loadinalunloading, site to the installation site by means and a method with less vibration as compared with the movement using the casters. This movement may be achieved in such a manner that the reflector unit is made to slide on rails installed on the floor or is transported by human power.

(5) At the installation site, the reflector of the reflector unit is attached to the end of the flight unit of the main body unit which has been moved first and fixed there, and the second vacuum vessel is attached and fixed to the end of the first vacuum vessel. The assembly of the TOFMS is thus completed at the installation site, and the TOFMS becomes usable.

In order to facilitate the transportation of the main body unit, desirably, the chassis has casters as described above.

In the TOFMS according to the present invention, the second vacuum vessel may be fixed on a sub-chassis via a damper for absorbing vibrations, and the sub-chassis may be fixed to the chassis. This makes is possible to more reliably fix the main body unit and the reflector unit to each other.

This sub-chassis may also have casters (sub-chassis casters). This facilitates the movement of the reflector unit. In this case, the damper described above reduces the influence of vibrations at the time of movement on the reflector. If appropriate countermeasures are taken against vibrations during the movement using the sub-chassis casters, the second vacuum vessel may be fixed on the sub-chassis without the damper, or may have the sub-chassis casters.

Desirably, the chassis has, in its bottom surface, a notch to receive the reflector unit, the notch being formed at a portion of the bottom surface immediately below a position (attachment position) where the second vacuum vessel is attached to the first vacuum vessel. With this structure, moving the reflector unit and placing it into the notch allows the reflector unit to be easily loaded to immediately below the attachment position, thus facilitating attaching work. In particular, when the reflector unit has sub-chassis casters, the reflector unit is loaded to immediately below the attachment position only by the movement using the sub-chassis casters. This further facilitates attaching work.

Advantageous Effects of Invention

In the TOFMS according to the present invention, the reflector unit is separated from the first vacuum vessel and the part of the flight unit accommodated in the first vacuum vessel. Accordingly, when the TOFMS is transported from the factory where the TOFMS is completed to the installation site, particularly when the TOFMS is transported from the loading/unloading site near the installation site to the installation site, the main body unit is easily moved by the casters provided for the chassis or the carriage on which the main body unit is mounted. Meanwhile, the reflector unit is moved to the installation site without being affected by the vibrations caused by the movement of the main body unit using the casters. Therefore, the high assembly accuracy of the reflector completed in the factory is maintained in the process of transporting and moving the TOFMS to the installation site.

DESCRIPTION OF EMBODIMENTS

With reference to FIGS. 1 to 6, a TOFMS according to an embodiment of the present invention will be described.

Figure 1:
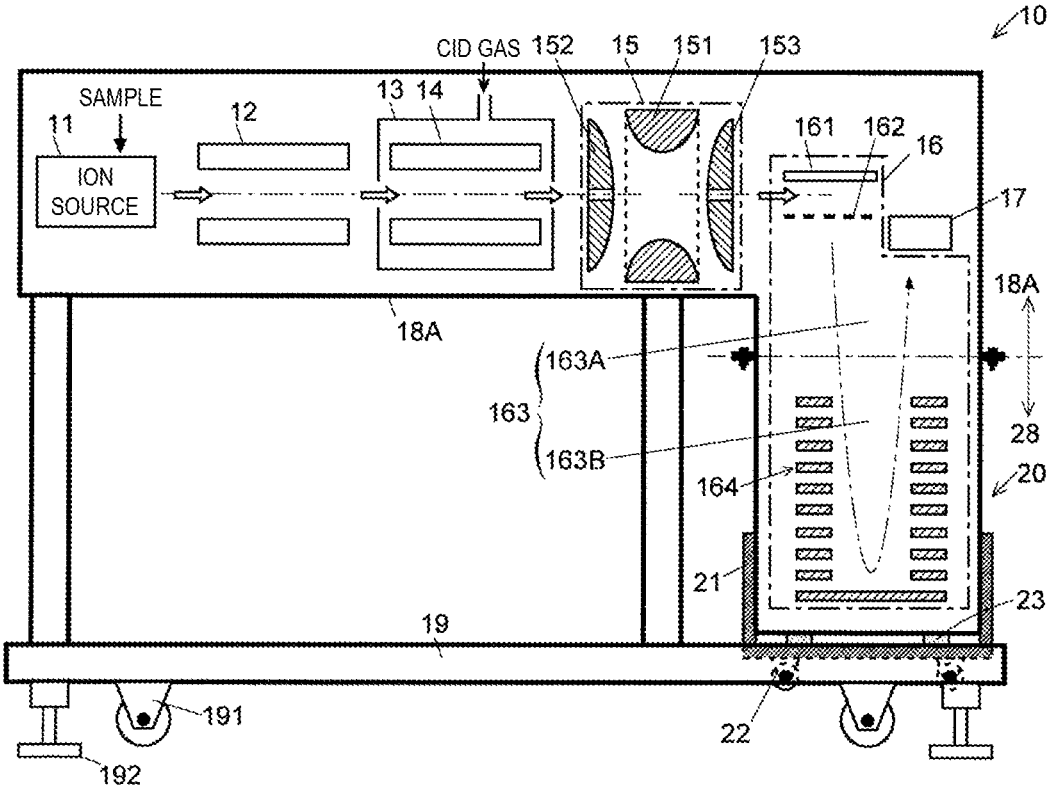
FIG. 1 is a schematic configuration diagram of a TOFMS according to an embodiment of the present invention.

As shown in FIG. 1, like the conventional TOFMS described above, a TOFMS 10 according to this embodiment includes an ion source 11, a quadrupole mass filter 12, a collision cell 13, an ion guide 14, an ion trap 15, a time-of-flight mass separator 16, and an ion detector 17. As described above, the time-of-flight mass separator 16 includes an expulsion electrode 161, a grid electrode 162, a TOFMS flight space 163, and a reflectron (reflector) 164. A portion from immediately after the ion source 11 to immediately before the time-of-flight mass separator 16 causes ions to fly almost horizontally, and the combination of the expulsion electrode 161 and the grid electrode 162 in the time-of-flight mass separator 16 accelerates the ions to make them fly downward. As described above, the TOFMS 10 according to this embodiment is an orthogonal acceleration type TOFMS that accelerates ions in a direction orthogonal to the incident direction of the ion beam.

The TOFMS 10 also includes a first vacuum vessel (upper vacuum vessel) 18A accommodating the ion source 11, the quadrupole mass filter 12, the collision cell 13, the ion guide 14, the ion trap 15, the expulsion electrode 161, the grid electrode 162, the ion detector 17, and an upper TOFMS flight space 163A that is a part of the TOFMS flight space 163. The first vacuum vessel 18A has, in longitudinal section view, such an L shape that one end of a transverse space extending in the transverse direction is connected to the upper end of a longitudinal space extending in the longitudinal direction. The ion source 11, the quadrupole mass filter 12, the collision cell 13, the ion guide 14, and the ion trap 15 are accommodated in the transverse space, and the TOFMS flight space 163 is formed in the longitudinal space. The quadrupole mass filter 12, the ion nuide 14, and the ion trap 15 correspond to the above-described ion transportation unit. The expulsion electrode 161, the grid electrode 162, and the ion detector 17 are disposed in a portion where the transverse space and the longitudinal space intersect. In the case of the first vacuum vessel 18A alone, the lower end of the longitudinal space is open.

The first vacuum vessel 18A is mounted and fixed on a chassis 19. As in the case of the conventional TOFMS, casters 191 and stoppers 192 are attached to the lower surface of the chassis 19.

The TOFMS 10 includes a second vacuum vessel (lower vacuum vessel) 28 accommodating the reflection 164 and a lower TOFMS flight space 163B that is the remaining part of the TOFMS flight space 163. In the case of the second vacuum vessel 28 alone, the upper end of the second vacuum vessel 28 is open. The lower end of the longitudinal space of the first vacuum vessel 18A and the upper end of the second vacuum vessel 28 are fastened with bolts, and a vacuum seal (not shown) for maintaining airtightness is disposed between the two vessels. This integrates the first vacuum vessel 18A with the second vacuum vessel 28 to form a vacuum space where ions fly.

The second vacuum vessel 28 is fixed to a sub-chassis 21. Sub-chassis casters 22 are attached to the lower surface of the sub-chassis 21. A damper 23 for absorbing vibrations is disposed between the sub-chassis 21 and the second vacuum vessel 28. The sub-chassis 21 is placed on the chassis 19 and fixed to the chassis 19 with bolts. In this state, the sub-chassis casters 22 are floating in the air. Note that the sub-chassis 21 may be fixed on a side portion of the chassis 19. In either case, fixing the sub-chassis 21 to the chassis 19 integrates the sub-chassis 21 with the chassis 19 (enables the sub-chassis 21 to serve as a part of the chassis 19), thereby increasing the strength of the chassis 19. The damper 23 may be disposed between the wall of the second vacuum vessel 28 and the reflection 164 from the viewpoint of not giving vibrations to the reflection 164. That is, the damper 23 may be disposed in the second vacuum vessel 28. However, the damper 23 generates a gas to cause a reduction in degree of vacuum in the second vacuum vessel 28. Hence, the damper 23 is desirably disposed between the second vacuum vessel 28 and the sub-chassis 21 located outside the second vacuum vessel 28.

Figure 2:
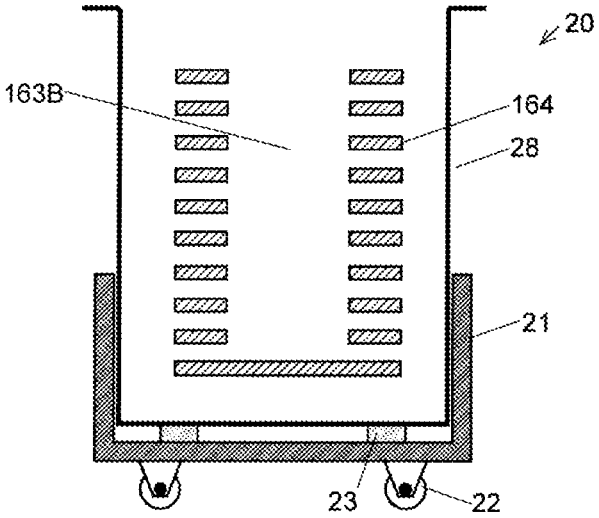
FIG. 2 is a schematic configuration diagram of a reflector unit in the TOFMS according to this embodiment.
Figure 3:
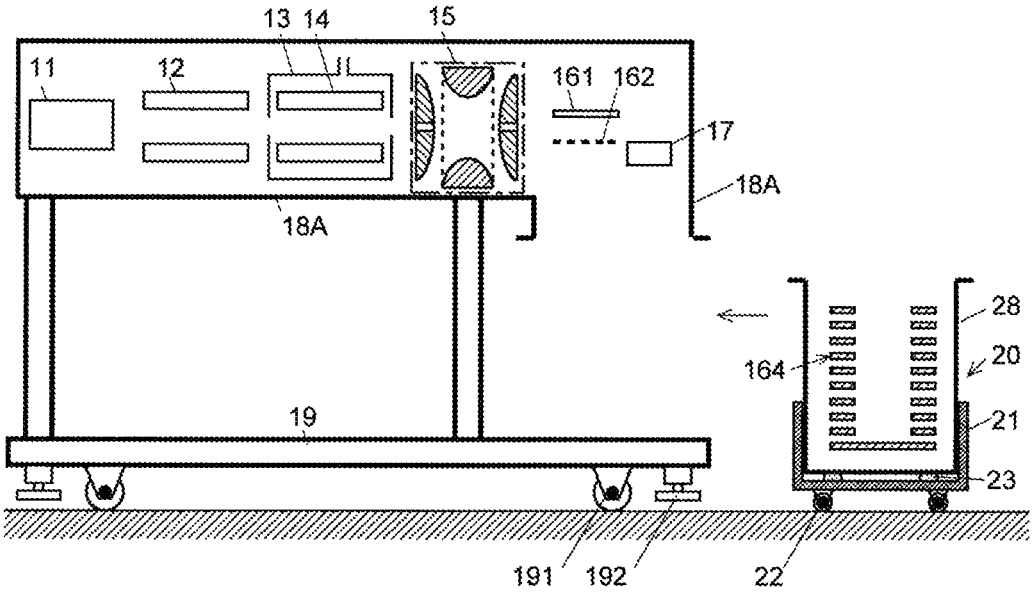
FIG. 3 is a schematic configuration diagram of the reflector unit and the other parts that are separated from each other in the TOFMS according to this embodiment.

The combination of the reflectron 164, the second vacuum vessel 28, the sub-chassis 21, the sub-chassis casters 22, and the damper 23 constitutes a reflector unit 20 (see FIG. 2).

The operation of the TOFMS 10 accordingto this embodiment at the time of mass spectrometry is similar to that of the conventional TOFMS; therefore, the description thereof is omitted. The following describes the operation to be performed in transporting the TOFMS 10 from the factory and then installing the TOFMS 10 in the installation site.

First, the finished TOFMS 10 is separated into the reflector unit 20 and the other parts (FIG. 3) in the factory. The parts other than the reflector unit 20 are moved by the casters 191 after releasing of the stoppers 192, and mounted on transportation means such as a truck. At that time, the vibrations received from the floor surface through the casters 191 are transmitted to the parts. However, since the reflectron 164 is separated from the parts, the reflection 164 is not affected by the vibrations. Meanwhile, the reflector unit 20 including the reflection 164 is moved to the transportation means as carefully as possible so as not to give vibrations to the reflector unit 20. At that time, the sub-chassis casters 22 may be used on the flat floor of the route to the transportation means since the damper 23 absorbs the vibrations. On the other hand, the reflector unit 20 is lifted and moved on the uneven road surface so as not to give vibrations to the reflectron 164 since the damper 23 may fail to sufficiently absorb the vibrations. Alternatively, the reflector unit 20 may be moved in such a manner that the reflector unit 20 is made to slide on rails placed on the floor surface.

Next, the reflector unit 20 and the other parts are transported to a loadinglunloading site near the installation site by the transportation means. At that time, at least the reflector unit 20 is transported by a method with special attention being paid not to give vibrations to the reflector unit 20 as much as possible, for example, using a truck equipped with an air suspension that absorbs vibrations or mounting the reflector unit 20 on a damping base.

After arriving at the loading/unloading site, the reflector unit 20 and the other parts are unloaded from the transportation means. Subsequently, as in the case of movement from the factory to the transportation means, the parts other than the reflector unit 20 are moved to the installation site by the casters 191 after releasing of the stoppers 192. In addition, as in the case of movement from the factory to the transportation means, with regard to the route to the installation site, the reflector unit 20 is moved on the flat floor by the casters 22, is moved on the uneven road surface while being lifted, or is moved by the rails placed on the floor surface.

At the installation site, first, the parts other than the reflector unit 20 are moved to the installation position of the TOFMS 10 and fixed at the installation position with the stoppers 192. Next, the reflector unit 20 is moved below the first vacuum vessel 18A, and the second vacuum vessel 28 and the first vacuum vessel 18A are fastened with bolts. Further, the sub-chassis 21 and the chassis 19 are fixed. The installation of the TOFMS 10 in the installation site is thus completed.

Figure 4:
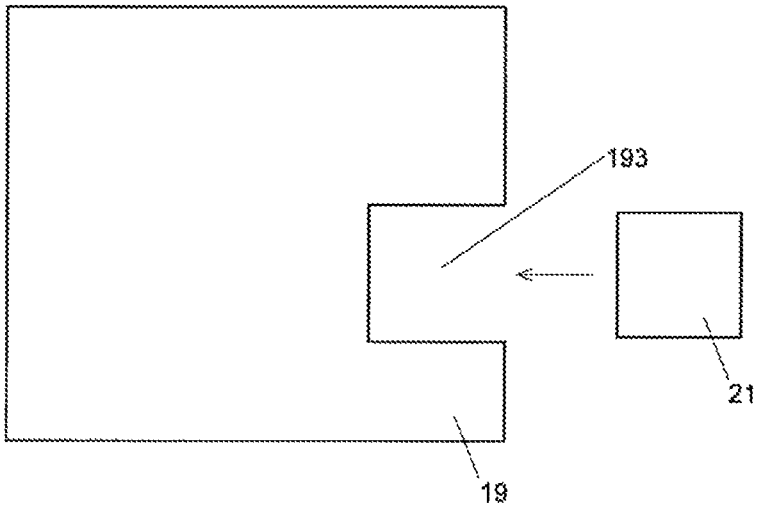
FIG. 4 is a top view of a chassis and a sub chassis in the TOFMS according to this embodiment.
Figure 5A:
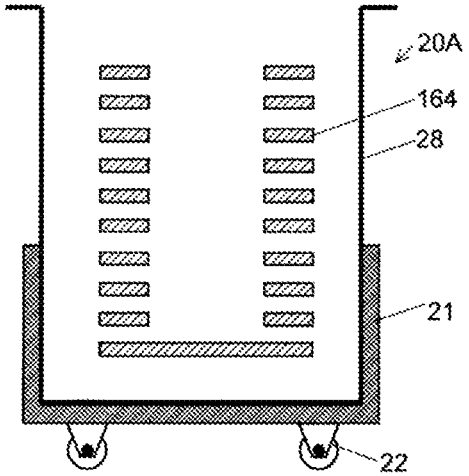
FIGS. 5A to 5D are schematic configuration diagrams of modifications of the reflector unit in the TOFMS according to this embodiment.
Figure 5B:
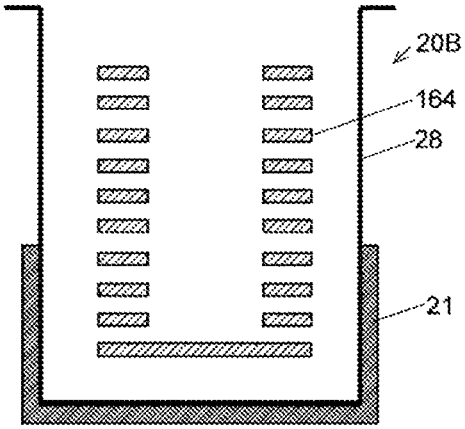
Figure 5C:
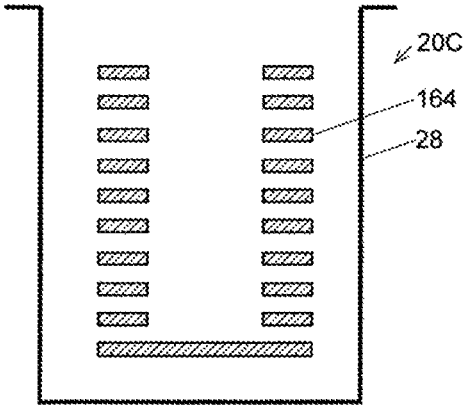
Figure 5D:
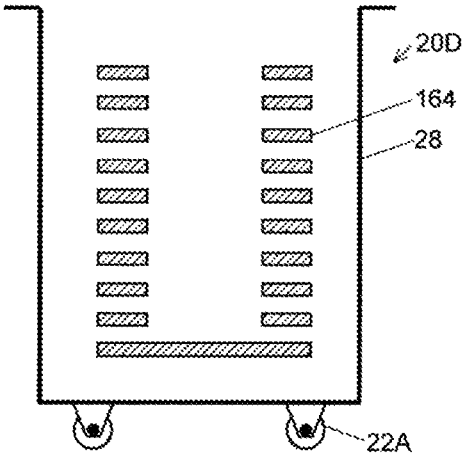

As shown in the top view of FIG. 4, the bottom surface of the chassis 19 has a notch 193 located immediately below the first vacuum vessel 18A and formed to receive the reflector unit 20. The notch 193 allows the sub-chassis casters 22 of the reflector unit 20 to easily move the reflector unit to immediately below the attachment position. Although this notch reduces the strength of the chassis 19, fixing the chassis 19 to the sub-chassis 21 of the reflector unit integrates the sub-chassis 21 with the chassis 19, thereby increasing the strength of the chassis 19.

In the TOFMS 10 according to this embodiment, the reflector unit 20 is separated from the other parts. Therefore, the reflector unit 20 is moved with the influence of vibrations suppressed at the time of transportation. The other parts are easily moved by the casters 191. Accordingly, the high assembly accuracy of the reflectron 164 completed in the factory is maintained in the process of transporting and moving the TOFMS 10 to the installation site.

In the TOFMS 10 according to this embodiment, since the reflector unit 20 includes the sub-chassis casters 22 and the damper 23, the sub-chassis casters 22 facilitates the movement of the reflector unit 20 on a flat floor surface. In use of the TOFMS 10, moreover, the damper 23 inhibits the vibrations generated due to a vacuum pump (not shown) or the like evacuating the interior of the vacuum vessel from being transmitted to the reflectron 164. This also contributes to maintaining high assembly accuracy of the reflectron 164.

The TOFMS according to this embodiment may be variously modified.

In the above embodiment, the damper 23 is disposed between the sub-chassis 21 and the second vacuum vessel 28. Alternatively, the damper 23 may be omitted as in the case of a reflector unit 20A shown in FIG. 5A. According to this configuration, in transporting the reflector unit 20A, the sub-chassis casters 22 are not used, and the reflector unit 20A is lifted and moved such that vibrations from the floor surface are not transmitted to the reflectron 164. However, in the situation of work at the installation site, when the floor surface is flat, the sub-chassis casters 22 may be used for a small distance to move the reflector unit 20A using the sub-chassis casters 22. This facilitates work at the installation site. Alternatively, the sub-chassis casters 22 may be omitted as in the case of a reflector unit 20B shown in FIG. 5B, or the sub-chassis 21 may be omitted as in the case of a reflector unit 20C shown in FIG. 5C, In addition, as in the case of a reflector unit 2013 shown in FIG. 5D, the sub-chassis 21 may be omitted and casters 22A may be disposed on the lower surface of the second vacuum vessel 28.

In the above embodiment, the casters 191 are disposed on the lower surface of the chassis 19. Alternatively, the casters 191 may be omitted. In this case, the chassis 19 may be mounted on a carriage having casters and moved to an installation site.

Figure 6:
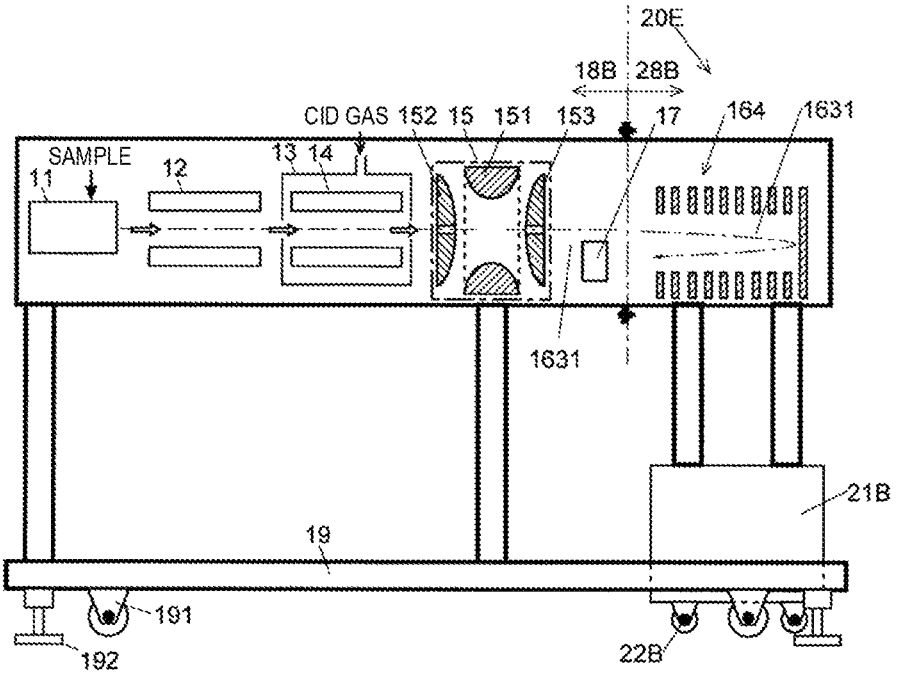
FIG. 6 is a schematic configuration diagram of a modification of the TOFMS according to the present invention.
Figure 7:
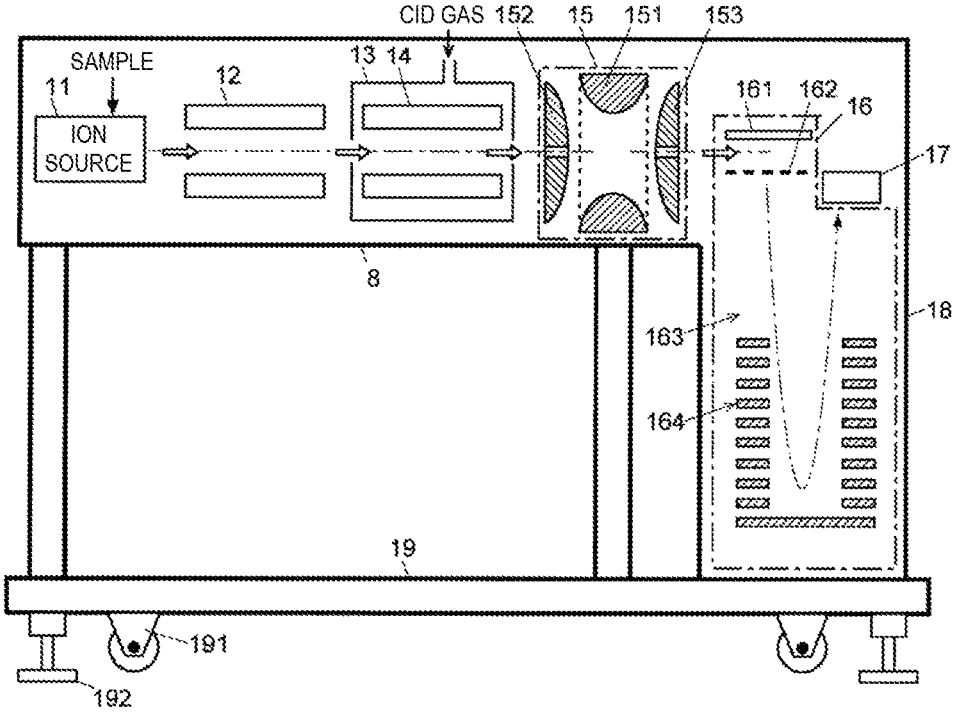
FIG. 7 is a schematic configuration diagram of an example of a conventional TOFMS.

In the above embodiment, the acceleration unit is of the orthogonal acceleration type that accelerates ions in a direction orthogonal to the incident direction of the ion beam. Alternatively, the ion trap 15 may be used to accelerate the ions in the same direction as the incident direction of the ion beam. FIG. 6 shows such an example. In this example, the ion trap 15 is provided such that ions traveling in the horizontal direction are incident. In addition, a TOFMS flight space 1631 in which ions fly in the horizontal direction and a reflection 1641 for reflecting the ions are disposed at the subsequent stage of the ion trap 15. The ion trap 15, each component on the preceding stage, the detector 17, and a part of the TOFMS flight space 1631 are accommodated in a first vacuum vessel 18B. The reflection 1641 and the remaining part of the TOFMS flight space 1631 are accommodated in a second vacuum vessel 28B. The first vacuum vessel 1813 and the second vacuum vessel 28B are provided such that their openings face each other at the same height and both are fastened so that the openings communicate with each other at the installation site. The second vacuum vessel 28B is disposed on a sub-chassis 21B via support columns, and the sub-chassis 21B has, on its lower surface, sub-chassis casters 22B. The reflectron 1641, a part of the TOFMS flight space 1631, the second vacuum vessel 28B, the sub-chassis 21B, and the sub-chassis casters 22B constitute a reflector unit 20E.

Obviously, the present invention is not limited to the above embodiments and the above modifications, and various modifications can be made.

REFERENCE SIGNS LIST

10 . . . TOFMS
11 . . . Ion Source
12 . . . Quadrupole Mass Filter
13 . . . Collision Cell
14 . . . Ion Guide
15 . . . Ion Trap
151 . . . Ring Electrode
152 . . . End Cap Electrode
16 . . . Time-of-flight Mass Separator
161 . . . Expulsion Electrode
162 . . . Grid Electrode
163, 1631 . . . TOFMS Flight Space
163A . . . Upper TOFMS Flight Space
163B . . . Lower TOFMS Flight Space
164, 1641 . . . Reflectron
17 . . . Ion Detector
18 . . . Vacuum Vessel
18A, 18B . . . First Vacuum Vessel
28, 28B . . . Second Vacuum Vessel
19 . . . Chassis
191 . . . Caster

192 . . . Stopper
20, 20A, 20B, 20C, 20D, 20E . . . Reflector Unit
21, 211 . . . Sub-chassis
22, 22B . . . Sub-chassis Caster
22A . . . Caster
23 . . . Damper

The invention claimed is:

1. A time-of-flight mass spectrometer for performing mass separation based on a time of flight of an ion flying in a flight space, the time-of-flight mass spectrometer comprising:

a) an acceleration unit configured to accelerate an ion to introduce the ion into the flight space;

b) a flight unit incorporating the flight space;

c) a first vacuum vessel enclosing the acceleration unit and at least a part of the flight unit; and d) a second vacuum vessel incorporating a reflector configured to reverse a flight trajectory of the ion accelerated by the acceleration unit and introduced into the flight space, the second vacuum vessel being attachable to an end of the first vacuum vessel and separable from the end of the first vacuum vessel.

2. The time-of-flight mass spectrometer according to claim 1, further comprising a chassis on which the first vacuum vessel is placed and a caster disposed on the chassis.

3. The time-of-flight mass spectrometer according to claim 2, further comprising a sub-chassis fixable to the chassis and configured to fix the second vacuum vessel.

4. The time-of-flight mass spectrometer according to claim 3, further comp a damper disposed between the second vacuum vessel and the sub-chassis and configured absorb vibration.

5. The time-of-flight mass spectrometer according to claim 4, wherein the sub-chassis has a sub-chassis caster.

6. The time-of-flight mass spectrometer according to claim 3, wherein the sub-chassis has a sub-chassis caster.

7. The time-of-flight mass spectrometer according to claim 6, wherein the chassis has, in its bottom surface, a notch to receive the sub-chassis, the notch being formed at a portion of the bottom surface immediately below a position where the second vessel is attached to the first vacuum vessel.

8. The time-of-flight mass spectrometer according to claim 2, wherein the chassis has, in its bottom surface, a notch to receive the second vacuum vessel, the notch being formed at a portion of the bottom surface immediately below a position where the second vacuum vessel is attached to the first vacuum vessel.

* * * * *